US007607848B1

(12) United States Patent
Ahmed et al.

(10) Patent No.: US 7,607,848 B1
(45) Date of Patent: Oct. 27, 2009

(54) SELECTABLY COMBINABLE MULTICOLOR MODULAR MARKER AND KIT AND PIGMENT MATERIAL DISPENSING MEANS

(76) Inventors: Cynthia G. Ahmed, P.O. Box 4254, Key West, FL (US) 33041; Kazi M. Ahmed, P.O. Box 4254, Key West, FL (US) 33041

( * ) Notice: Subject to any disclaimer, the term of this patent is extended or adjusted under 35 U.S.C. 154(b) by 443 days.

(21) Appl. No.: 11/044,319

(22) Filed: Jan. 27, 2005

Related U.S. Application Data

(60) Provisional application No. 60/539,191, filed on Jan. 27, 2004.

(51) Int. Cl.
*B43K 27/04* (2006.01)

(52) U.S. Cl. ..... 401/35; 401/34

(58) Field of Classification Search ..... 401/34, 401/35, 17, 18, 22, 23, 195
See application file for complete search history.

(56) References Cited

U.S. PATENT DOCUMENTS

| | | | | |
|---|---|---|---|---|
| 5,044,804 | A * | 9/1991 | Chuang | 401/34 |
| 6,425,703 | B1 * | 7/2002 | McDonnell et al. | 401/34 |
| 6,554,517 | B2 * | 4/2003 | Ahmed | 401/35 |

* cited by examiner

*Primary Examiner*—David J Walczak
(74) *Attorney, Agent, or Firm*—Oltman, Flynn & Kubler

(57) ABSTRACT

A modular marker kit for delivering pigment onto a receiving surface includes a first modular marker and a second modular marker, each module marker including a tubular housing having a housing proximal end and a housing distal end, a quantity of pigment material contained within the housing, and first and second arm sets of interconnection arms connected to and protruding laterally from the housing in opposing directions for engaging an adjacent such marker, the arms forming each arm set being staggered in that they are spaced apart from each other along the length of the housing from which they protrude, each arm set including an upper arm and a lower arm; so that spaced apart upper and lower arm pairs interconnect the first and second markers, preventing the first and second markers from pivoting relative to each other when interconnected, and so that the upper arm of one arm set on the first marker combines with the upper arm of an adjacent arm set of the second marker, and so that each arm set contributes one arm to the upper arm pair and one arm to the lower arm pair.

13 Claims, 9 Drawing Sheets

Fig. 12
(Prior Art)
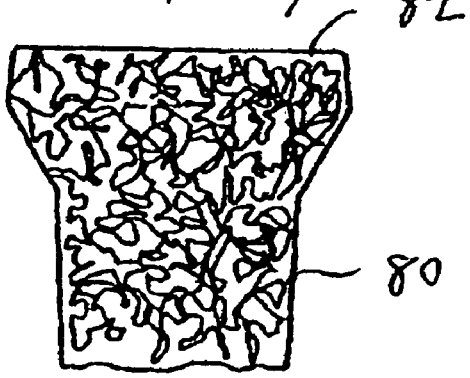
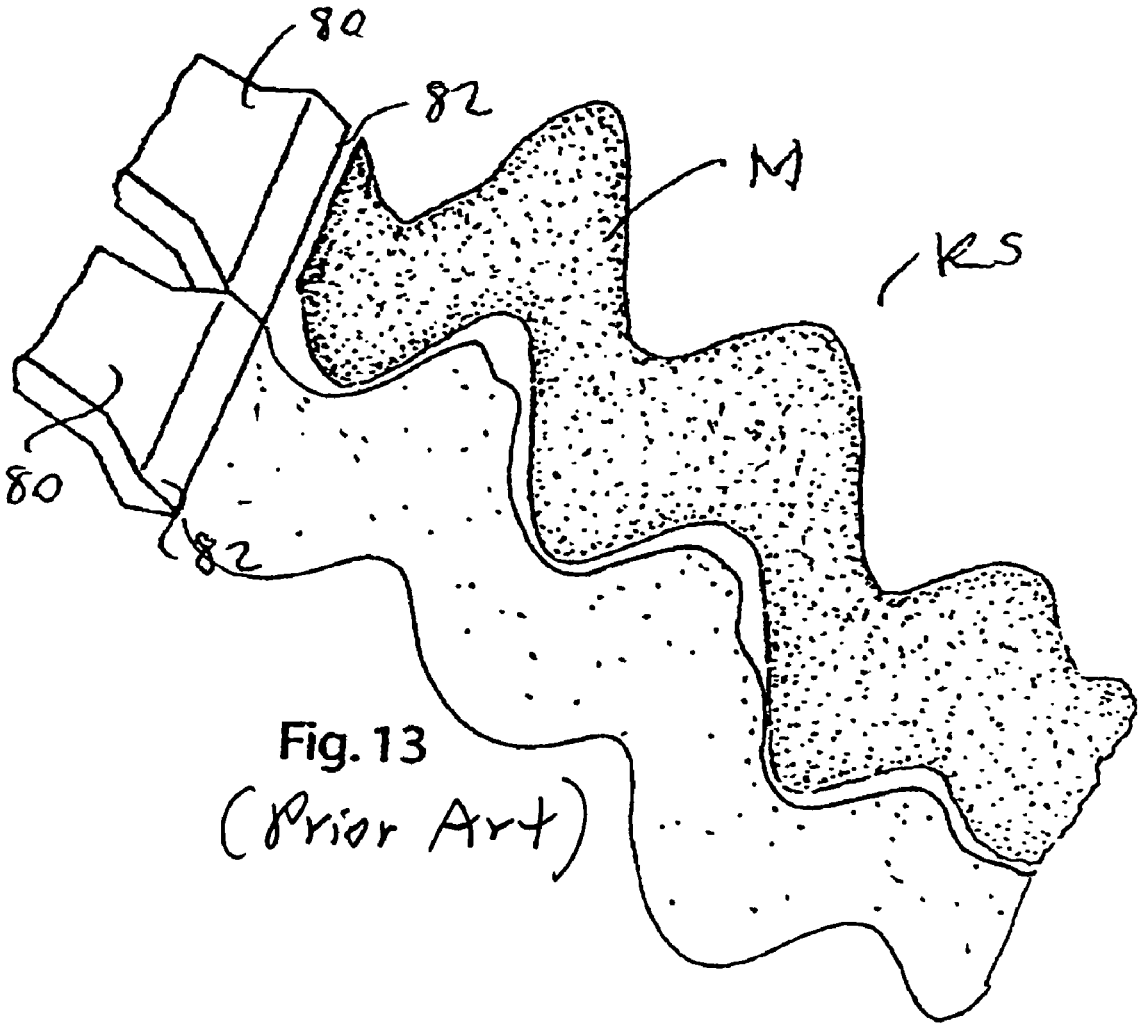
Fig. 13
(Prior Art)

Fig. 16
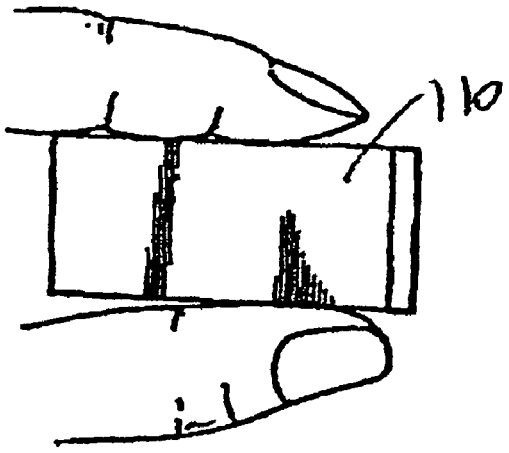
Fig. 17
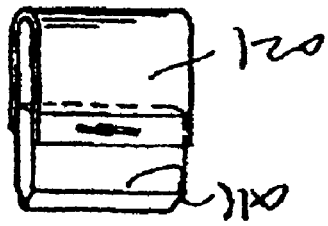
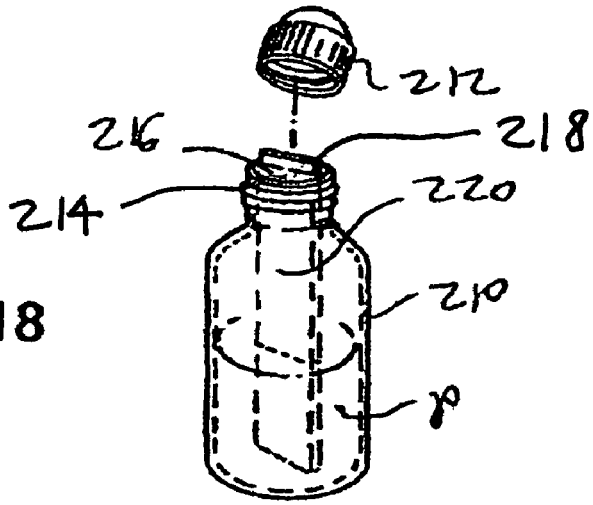
Fig. 18
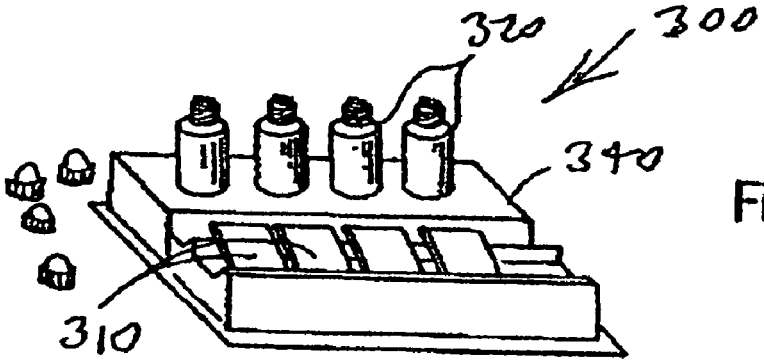
Fig. 19

SELECTABLY COMBINABLE MULTICOLOR MODULAR MARKER AND KIT AND PIGMENT MATERIAL DISPENSING MEANS

FILING HISTORY

This application continues from provisional application No. 60/539,191 filed on Jan. 27, 2004.

BACKGROUND OF THE INVENTION

1. Field of the Invention

The present invention relates generally to the field of devices for delivering pigment material onto receiving surfaces of other objects. More specifically the present invention relates to a modular marker removably interconnectable to other such modular marker in selectable numbers and combinations to produce adjacent and parallel elongate markings on a receiving surface of different colors similar to a rainbow, and to a kit including several such modular markers containing different pigment materials producing different colored bands in the composite marking.

Each modular marker includes a marker housing in the form of a circular tube having a housing proximal end and having a housing distal end through which pigment material is delivered onto a receiving surface. A tubular cover cap is provided having a cap closed end and a cap open end for fitting over the housing distal end. The housing of each marker has laterally protruding marker interconnection arms preferably having a flat shape in the configuration of flanges for engaging an adjacent such marker so that markers are interconnectable and can only be interconnected along a collective straight line. Each interconnection arm (hereinafter "arm") is flexible and resilient and has a curve along its length to fit around the curvature of and resiliently engage an adjacent marker housing. First and second arm sets, each including two arms protrude from the marker housing in directly opposing directions, so that two spaced apart arm engaging pairs interconnect adjacent markers in mutually parallel relation, preventing the markers from pivoting relative to each other out of parallel. For purposes of this application, the term "arm set" refers to two arms protruding from one side of the marker housing, while the term "arm pair" refers to the arms working in unison to interconnect two markers.

A key feature of each arm set is that the two arms making up the set are staggered in that they are spaced apart from each other along the length of the housing from which they protrude, so that each arm set includes an arm set upper arm and an arm set lower arm. The upper and lower arms of a given arm set combine with the lower and upper arms of an adjacent arm set of another marker to produce an upper arm pair and a lower arm pair spaced longitudinally from the upper arm pair. Each arm set contributes one upper arm to the upper arm pair, and one lower arm to the lower arm pair. The upper and lower arms of each arm set, in addition to being staggered longitudinally, extend from the marker housing at circumferentially spread apart angular positions. The staggered arm construction permits either arm set on one marker to interconnect with either arm set on another such marker, as long as the marker distal ends are pointing in the same direction. As a result, there is no need to study which way a given marker housing has to be oriented to connect to another such adjacent marker. A pigment material sealing elastomer ring resiliently fits around and into a reduced diameter segment of a nib holder at the housing distal end retaining a marking nib. The elastomer ring protrudes radially beyond the lateral extent of the nib, and the cover cap open end is sized to slide snugly, sealingly and engagingly over the elastomer ring so that ink cannot leak in the marker when it is not in use. The elastomer ring is also resiliently deformable to an extent that when marker cover caps are removed and one marker is interconnected with another and the marker elastomer rings are immediately adjacent and abutting each other, the rings compress sufficiently that the nibs of the markers can laterally abut each other to produce composite parallel marks of different colors which are contiguous. As a result, the elastomeric ring provides its sealing function without interfering with the interconnection function of the interconnection arms placing the nib distal ends adjacent to each other.

2. Description of the Prior Art

There are several areas of prior art relating to the present invention. One such area is that of modular multi-color markers, another is that of nib material for such markers, and yet another is that of wick material for multi-color painting brushes. And a final area is that of painting kits for multi-color marking.

Modular Markers:

An example of prior art modular marking pens using flanges to grip adjacent pens is that of Faber-Castell, AU-A-52038/90, which shows a marker fitted with a cap, the cap having two parallel axially extending flanges spaced for more than the thickness of the pen shaft, in order to grip another identical pen. One cannot draw multi-color lines, either with spaces of contiguous, with these markers due to the flangular cap only being able to fit onto the nib end of the marker. Therefore, the marker bodies only grip one another when they are capped closed.

Other prior art, especially from applicant's previous U.S. Pat. No. 6,554,517 B2, proposes different embodiments of modular markers each having means of connecting by way of male and female parts. The male side of one marker must be fitted by a button, a sliding, or a holder means, into a corresponding female side of another marker. FIG. 1 is a prior art of applicant.

This means is the most commonly seen one for connecting markers together, but there has not been proposed a means of connection that overcomes the need for a male and female part on opposite sides of markers, and that obviates the need for people to look carefully at the markers, determine which sides fit together and perhaps have to turn one of the markers around in order to mate them correctly.

Prior art shown in FIG. 2 is by applicant from 2003, and discloses a modular marker with a long cap, the cap having a diameter large enough for the nib to be inserted without touching the insides of the cap, while the nib width is required to be as wide as or slightly wider than the widest diameter of the marker body in order for the nibs to touch when the markers are connected. Such a long cap is one method of capping the proposed marker. However, it requires a long rod to be inserted in the mould to form the void in the cap which is difficult to prevent from moving as the plastic is being injected, thus resulting in slightly asymmetrical caps. A means, therefore, is proposed in this invention that permits a shorter cap to be used.

Prior art from applicant in 2003 also discloses a nib of generic material, widened at the nib to be able to touch the adjacent nib of a connected marker. Until recently, it was not known what the best material for the nib would be.

Nibs:

seen in the prior art for fixed position multicolor markers have been nibs of longitudinally aligned fiber, porous plastic, and synthetic needle-punched fiber. Each material has similar advantages: they are rigid for insertion into marker bodies, their tips can be formed to a precise shape, and they are suitable for various water-based inks typically desired in multicolor markers. However, the rigidity and high density of each marker becomes an undesired factor when used with markers from previous applicant U.S. Pat. No. 6,554,517 that discloses modular multi-color markers and markers with variable nibs.

The longitudinally aligned fiber nibs and porous plastic nibs that are currently being manufactured are more rigid than needle-punched fiber, and are being used in multi-color marking pens with fixed position nibs. For example in prior art from Jakks Pacific, Inc's R.O.C. (Rainbow of Color) Writer™ which discloses a multi-color marker that draws three colored lines simultaneously, the porous plastic nibs are in fixed position with small gaps between them to keep the ink from blending and muddy. The full width of their tips do not always fully contact the paper enough to lay down lines of the intended width because the manufacturing or assembling of the product is not completely perfect. Thus, the nibs tend to be slightly angled to each other, aligned unevenly perpendicular to the intended lines or are extending unequal distances from the marker body. Even though this unevenness of the nibs may be so small that it is difficult to detect with the naked eye, it results in uneven lines with broad gaps between them. Also, upon normal usage, the outermost nibs wear away faster than the centermost nib, resulting in only two lines being able to be drawn at one time. If the nibs were soft enough, one could apply a moderate amount of pressure and have all of the nibs fully contact paper, but because the nibs are rigid plastic one would have to apply an extraordinary amount of pressure which would make it impossible to write, draw or paint normally.

Another prior art from Sun Star, Japan, discloses a two-color marker with two longitudinally aligned fiber nibs side by side. As the nibs leave the marker body they slightly angle away from each other to keep the nibs from touching at their tips thus preventing ink from mingling. Again, the nib's rigidity is used to keep the nibs separate, thus producing gapped lines.

Thus far applicant has been using higher density die-cut synthetic needed nonwoven or needle-punched material specifically engineered for low viscosity fluid for applicant's nibs. It is sanded in the factory to either a smooth, chisel or beveled tip. These nibs provide the shape, rigidity and fluid flow rate needed for the modular multi-color markers. However, applicant has found that due to the many variables in molding the plastic parts of multi-color markers, slight imperfections in the manufacture of the nibs, and the markers, final assembly, the nibs rarely lined up perfectly for contiguous lines. Applicant needed to improve the nibs to provide a "fuzzy logic" factor which could hide these imprecisions or variables.

Brushes:

as relates to brushes for painting contiguous multi-colored strokes, well known brushes are made of hair and bristles, whether synthetic or natural, sponge, and wool felt. Other materials that have been considered and tested are felted wool blend product and leather.

A most recent prior art is from popular artist, Donna Dewberry, using "sponge painters" and Fold Art™ One Stroke™ brushes. However, her work utilizes Fold Art™ acrylic paints which are high viscosity and would not easily flow through the other types of material for brushes. Another example is Dee Gruenig's product, called Posh and one high density sponge 23 mm thick by 40 mm wide and by 76 mm long. This sponge is the only one known in the prior art to be used with low viscosity ink. Other foam and sponge painting devices are low density and are typically used for high viscosity paints such as acrylics and so are very soft and tend to release too much low viscosity ink or paint when pressed onto paper with the same amount of pressure one normally uses to apply acrylic paint, or when strokes are applied slowly. Gruenig's sponge is similar to wedge-shaped sponges for applying make-up, but higher density. They are able to hold and release low viscosity ink and paint well on its surface, but do not have a natural wicking ability to absorb fluid into its pores. Therefore, ink or paint must continually be carefully applied to its surface. It also has a rubbery, high friction surface that squeaks when there is not enough fluid to lubricate it when stroked on paper. This sponge, as well as low density ones and foam brushes are not very durable as they tend to tear easily.

Another example is from street artists who paint people's names in multi-colored strokes by touching a wide tip brush onto several different colors of paint or ink. Some call themselves "leather-brush artists" while others state that they use other materials such as felted fiber shoe inserts, sponges and foam. However, it is apparent from testing that all of these materials have serious drawbacks. Leather does not have interconnected capillary passageways extending therethrough for the absorption and dispersion of paint. Felted fiber shoe inserts usually are not as compressed or tightly needled as hat felt, resulting in easily fraying edges. They are typically designed to be rough for non-slippage, cushioning for shock absorption, able to wick moisture and permit air flow for preventing athlete's foot, and/or thick for insulation in winter footwear. Therefore, it typically does not have the proper characteristics for taking up and dispersing ink or paint, which have viscosity and surface tension near that of water.

Although the best prior art material we found for multicolor painting is wool felt for hats, it has never been manufactured in a convenient form specifically for painting. Therefore, applicant has had to go through the inconvenient process of purchasing finished hats, which cost at least ten times more than the same amount of sheet felt, cut rectangles from the least curved parts, normally the rim, perhaps wash it to eliminate any dark coloring which will affect the color of the paint applicant uses and sand the tip to a chisel shape.

There are several reasons why wool felt has not been commercially developed as a water-based paint or ink brush. The first is that wool is hydrophobic and does not wick water-based paint or ink well unless treated with a surfactant, second, recent environmental regulations have made the process of producing wool felt nibs more costly; third, wool is being replaced by the less expensive, more versatile variety of synthetic fibers. Marker pens with wool felt nibs are generally used with solvent based ink for specialized applications where cost and the inhaling of evaporating solvents are not a concern. One such application is the marking of cardboard containers in an industrial shipping and receiving facility.

Quickly replacing solvent-based ink markers, recent broad-nibbed markers, called paint markers, have been developed using low density synthetic needle-punched material and water-based pigmented permanent ink. The nibs may be up to 8 mm thick and 50 mm wide. However, these markers have been designed to apply only one color of ink or paint at a time. Their nibs are too soft for multi-color marking because the low density fiber structure means larger voids, where different colors of ink quickly intermingle and the nib becomes "muddy".

Thus, it is obvious from the prior art that there remains a need for brush products for painting multi-colored strokes that are made of synthetic needle-punched material engineered for marking pen nibs.

Painting Kits:

Not only has applicant not seen any brushes for multi-colored painting made of synthetic needle-punched nib material but furthermore, applicant sees the need for them to be assembled in a kit along with the right inks in a convenient, spill-proof dispensing system for the use of amateur artists and craftspeople desiring to learn the art of rainbow name painting. The aforementioned kits from Dee Gruenig and Donna Dewberry, plus Szelkely's Water Color Painting Apparatus (Szelkely U.S. Pat. No. 5,318,171), disclose kits for painting multi-colored lines or markings. However, they use foam sponge material for the paint applicators. Also, the means of dispensing ink in these prior art kits is unsuitable or tedious for the purpose of quick, accurate, multiple applications of paint to the brush for prolific painting. The drawback of Gruenig's paint dispensing system is that a user requires two hands—one to hold the sponge and the other to squeeze a minute amount of paint from the bottle onto the desired area of the sponge. One requires fine control over the squeezing of the bottle to dispense the right amount. Dewberry's kit does not pertain to applicant's method of watercolor painting because it utilizes thick, viscous paint, which is simply dispensed freely onto a waterproof surface. The paint has an adherent quality and does not spill or slide off the surface easily. Szelkely's painting apparatus is now being marketed as the "Rainbow Art Kit" and uses hard, dry blocks or paint secured in a tray or stand. The method of wetting to soften and loosen the paints is too time-consuming to be seriously considered for applicant's painting purposes.

Artists who do traditional rainbow name art use a system consisting of sponges situated in a container of paint with one end of the sponge protruding above the opening of the jar to dispense paint. The artist would be able to dab a specific section of the tip of his brush onto the sponge to wick up some paint. This system works well for adult professional artists, but is not easily obtainable, due to cost restraints and availability, to the general public market.

The best system would be similar to a fat, upside down marking pen. It would have a bottle-like enclosure for holding paint, which is narrow at the top (neck) for preventing excessive evaporation of ink. When the solvent and/or water in the paint evaporates, the paint becomes too viscous for the wicking action, and clogs the brushes' pores. Protruding from the neck and extending down all the way to the bottom of the bottle would be a wick for dispensing paint or ink. The wick needs to be stiff enough to not flop over when dabbed with a brush. It also needs to protrude far enough that the user's brush does not touch any other part of the bottle dispenser while dabbing. The wick would completely fill the neck orifice/opening except for a minute gap or hole to permit a sufficient airflow into the bottle as paint/ink is being drawn out. This would prevent spillage of paint/ink. A cap would cover the wick and orifice airtight and leak-tight.

These features are very important for professional and non-professional artists alike, and yet no system has existed prior to this invention. There are several reasons for this: for one, the very fine particle-size, highly pigmented paint that is traditionally used for this system is expensive and difficult to obtain, being used mostly by only a few people for this specific application and for high quality airbrush work. The best paint, however, is actually watercolor ink or dye which is used in marking pens, and which is not sold except as part of marking pens, and the quantities of ink in them are not sufficient to make it worth the trouble to cut open a marker and extract the ink. Other inks and dyes available in larger quantities to the general public market are found in bingo dabbers, are for calligraphy and fountain pens, and food coloring. However, these inks and dyes are too diluted for the bright colors needed for rainbow name art. There is a need, then, for a readily available end cost effective system which combines the right type of coloring fluid, whether ink, paint or dye, with the right type of dispensing container.

A second reason that a kit such as this has not been invented is because small, fluid-tight containers of the right size, with small neck openings and with a cap that will cover the wick but not push it down into the opening are difficult to find. Most caps cover the opening flush, thereby pushing the wick down into the neck until it is flush with the opening. The user then has the job of pulling the wick out of the opening, which typically means getting tweezers, fingers or other pointed gripping object, dirty. This type of container must be specially ordered in quantities and the neck modified to fit the wick, or must be specially designed and manufactured. The wick must also be specially sized to fit the container.

It is thus an object of the present invention to provide a selectably combinable multicolor modular marker and kit in which the markers are connectable to other such modular markers in selectable numbers and combinations to produce adjacent, parallel and contiguous elongate markings of different colors similar to a rainbow on a receiving surface.

It is another object of the present invention to provide such a marker and kit in which the markers each have diametrically opposing sets of arms for removably interconnecting the markers permitting either arm set of one marker to interconnect with either arm set of another such marker so that there is no need to determine which arm set on one marker will connect with which arm set on another marker.

It is still another object of the present invention to provide such a marker and kit in which the arms constrain the markers to interconnect along a straight line.

It is finally an object of the present invention to provide such a marker and kit which utilizes the child-safe and convenient ink-dispensing features of a marker, with or without the interconnecting arms, supplied with the soft, engineered material for marker nibs separate and outside from the marker, for use in the traditional method of rainbow name painting for which this present invention is made.

SUMMARY OF THE INVENTION

The present invention accomplishes the above-stated objectives, as well as others, as may be determined by a fair reading and interpretation of the entire specification.

A modular marker kit is provided for delivering pigment onto a receiving surface, including a first modular marker and a second modular marker, each module marker including a tubular housing having a housing proximal end and a housing distal end, a quantity of pigment material contained within the housing, and first and second arm sets of interconnection arms connected to and protruding laterally from the housing in opposing directions for engaging an adjacent such marker, the arms forming each arm set being staggered in that they are spaced apart from each other along the length of the housing from which they protrude, each arm set including an upper arm and a lower arm; so that spaced apart upper and lower arm pairs interconnect the first and second markers, preventing the first and second markers from pivoting relative to each other when interconnected, and so that the upper arm of one arm set on the first marker combines with the upper arm of an adjacent arm set of the second marker, and so that each arm set contributes one arm to the upper arm pair and one arm to the lower arm pair.

A modular marker for delivering pigment onto a receiving surface, including a tubular housing having a housing proximal end and a housing distal end; a quantity of pigment material contained within the housing; and arm set of interconnection arms connected to and protruding laterally from the housing in opposing directions for engaging an adjacent such marker, the arms forming the arm set being staggered and spaced apart along the length of the housing, the arm set including an upper arm and a lower arm; so that spaced apart upper and lower arm pairs interconnect each pair of adjacent markers, preventing interconnected markers from pivoting relative to each other, and so that upper arm of the arm set combines with an upper arm of an adjacent arm set of another marker, and so that each arm set contributes one arm to the upper arm pair and one arm to the lower arm pair.

A modular marker kit is further provided for delivering pigment onto a receiving surface, including a first modular marker and a second modular marker, each modular marker including a tubular housing having a housing proximal end and a housing distal end, a quantity of pigment material contained within the housing, a pigment depositing nib protruding from the housing distal end and in fluid communication with the quantity of pigment material, modular marker interconnection structure protruding laterally from the modular marker for laterally interconnecting with another marker; where the pigment depositing nibs are formed of deformable and resilient material which is sufficiently soft that the nibs of the first and second markers are readily compressible distally against a receiving surface to expand the nibs laterally so that the nibs contact each other.

A modular marker yet further provided for delivering pigment onto a receiving surface, including a tubular housing having a housing proximal end and a housing distal end; a quantity of pigment material contained within the housing; and first and second arm sets of interconnection arms connected to and protruding laterally from the housing in opposing directions for engaging an adjacent such marker, the arms forming each arm set being staggered and spaced apart along the length of the housing, each arm set including an upper arm and a lower arm; so that spaced apart upper and lower arm pairs interconnect each pair of adjacent markers, preventing interconnected markers from pivoting relative to each other, and so that each lateral arm set contributes one arm to the upper arm pair and one arm to the lower arm pair.

The interconnection arms preferably are flexible and resilient. Each interconnection arm preferably has a curve along its length to fit around and resiliently engage an adjacent the marker housing. The upper and lower interconnection arms of each lateral arm set, in addition to being staggered longitudinally, extend from the marker housing at circumferentially spaced apart angles. The quantity of pigment material preferably is ink retained within a cylindrical ink reservoir, and where the housing proximal end is open so that the ink reservoir can be inserted and removed from the housing for replacement through the housing proximal end, and where a housing plug is removably and engagingly fitted into the housing proximal end to sealingly close the housing proximal end.

The modular marker preferably additionally includes a pigment delivery structure for delivering the pigment material from the housing onto a receiving surface. The pigment delivery structure preferably includes a marking nib in fluid communication with the ink reservoir. The modular marker preferably additionally includes a tubular nib holder having a holder proximal end connected to the housing distal end and having a holder distal end and containing an axial holder passageway opening through the holder distal end as a nib exposing slot in the holder distal end permitting the nib to protrude both distally and laterally from the nib holder, and where the nib has a broad flat nib distal end and a tapered nib proximal end and the nib is mounted within the tubular nib holder and the nib proximal end protrudes proximally beyond the nib holder proximal end to receiving ink from the ink reservoir within the housing. The modular marker preferably additionally includes a cover cap having a cover cap open end, and an elastomer ring resiliently fit around the nib holder, so that the elastomeric ring protrudes radially beyond the lateral extent of the nib holder, and where the cover cap open end is sized to fit snugly, sealingly and engagingly over the elastomeric ring preventing ink from leaking out of the marker housing. The elastomeric ring preferably is resiliently deformable to an extent that when the marker cover cap is removed from the marker housing and one marker is interconnected with another marker, and the marker elastomer rings are consequently immediately adjacent and abutting each other, the elastomeric rings compress sufficiently that the nib distal ends of the markers substantially laterally abut each other to produce composite parallel marks on a receiving surface of different colors which are contiguous.

A painting kit preferably includes several brushes; several containers of different colors of paint; and a brush and container retaining tray.

BRIEF DESCRIPTION OF THE DRAWINGS

Various other objects, advantages, and features of the invention will become apparent to those skilled in the art from the following discussion taken in conjunction with the following drawings, in which:

FIG. 12 is a broken away side view of a nib distal end cut from fibrous nib material with entangled, compressed fibers.

FIG. 13 is a perspective view of two of the nibs of FIG. 12 aligned adjacently and then pressed against and drawn over a receiving surface such as paper.

FIG. 16 is a side view of a synthetic needle-punched fiber brush without the handle, being gripped by user fingers.

FIG. 17 is a perspective side view of a needle-punched fiber brush with a handle.

FIG. 18 is a perspective view of a paint/ink dispenser with a wick, orifice reducer, and a dispenser cap.

FIG. 19 is a perspective view of a painting kit including a tray apparatus with four brushes, four ink dispensers and a tray.

DETAILED DESCRIPTION OF THE PREFERRED EMBODIMENTS

Figure 1:
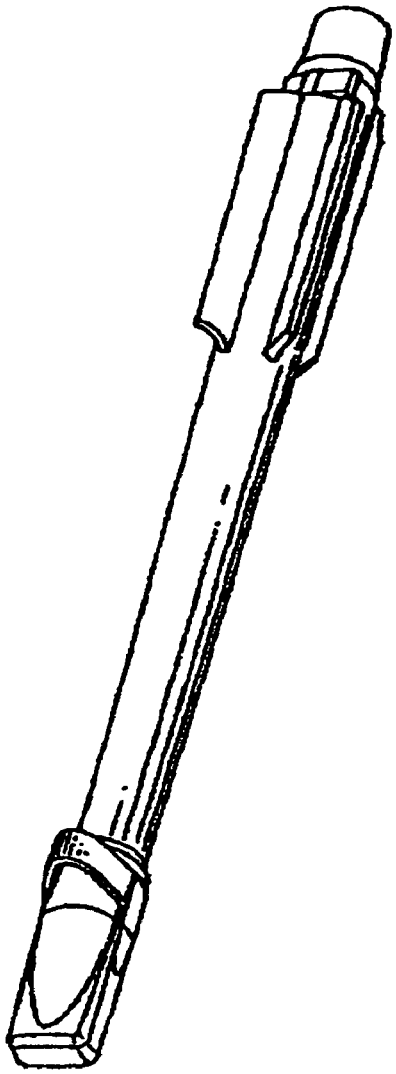
Fig. 1 PRIOR ART
FIG. 1 is a perspective view of a prior art modular marker.
Figure 2:
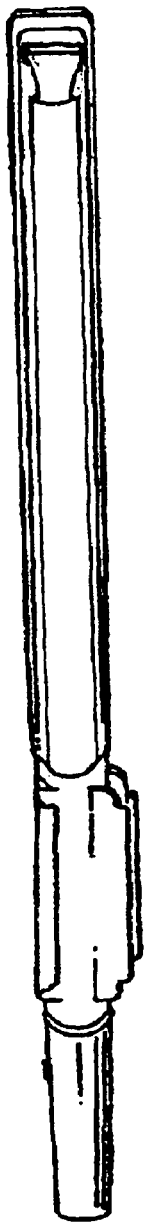
Fig. 2 PRIOR ART
FIG. 2 is a side view of a prior art modular marker with a long cap to accommodate the wide nib and seal at the widest point of the marker body.
Figure 3:
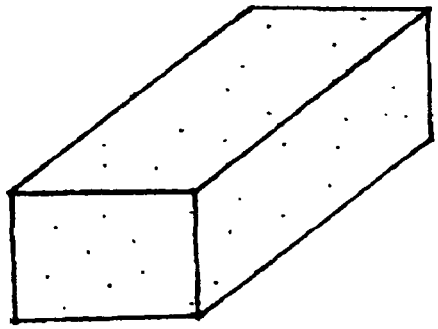
Fig. 3 PRIOR ART
FIG. 3 is a perspective view of a prior art high density painting sponge.
Figure 4:
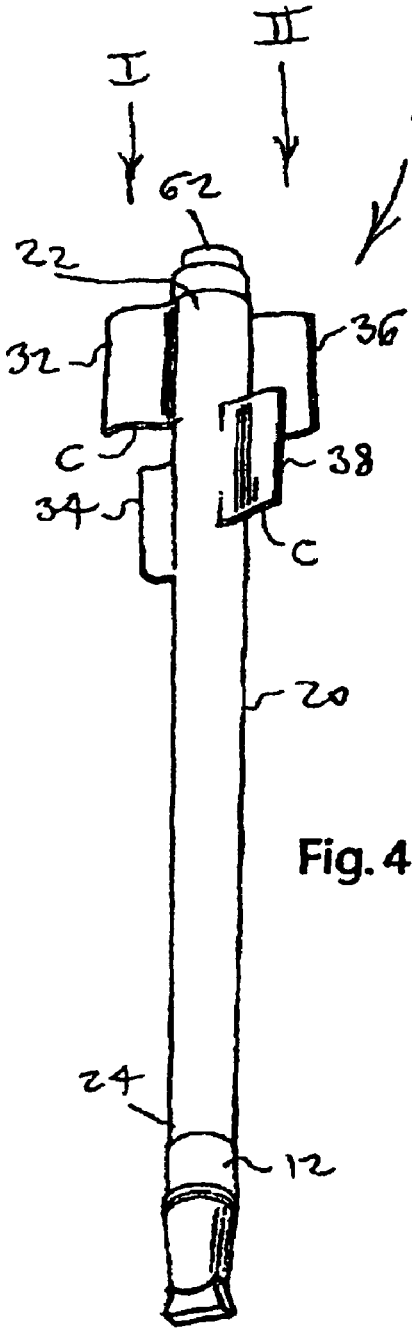
FIG. 4 is a perspective side view of the preferred embodiment of the present modular marker with the cover removed, showing the interconnection arms and exposed nib.
Figure 5:
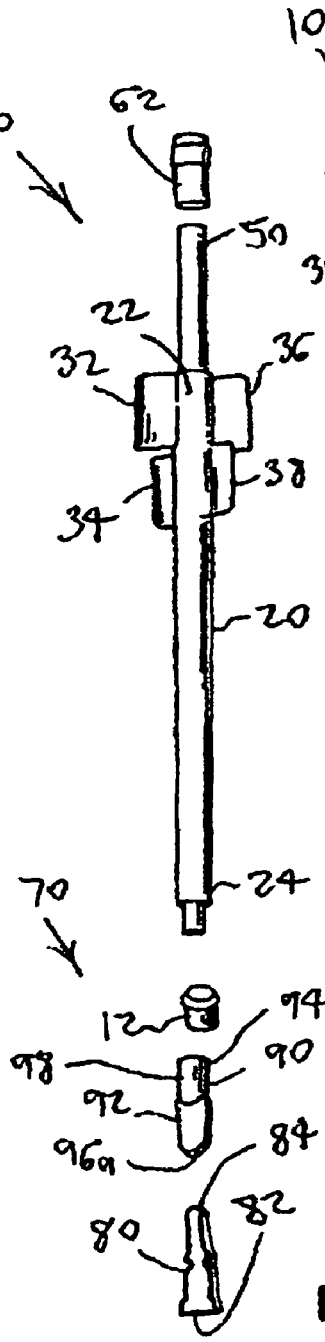
FIG. 5 is an exploded side view of the present marker of FIG. 4, showing the housing plug, ink reservoir, elastomeric ring, nib holder and nib.
Figure 6:
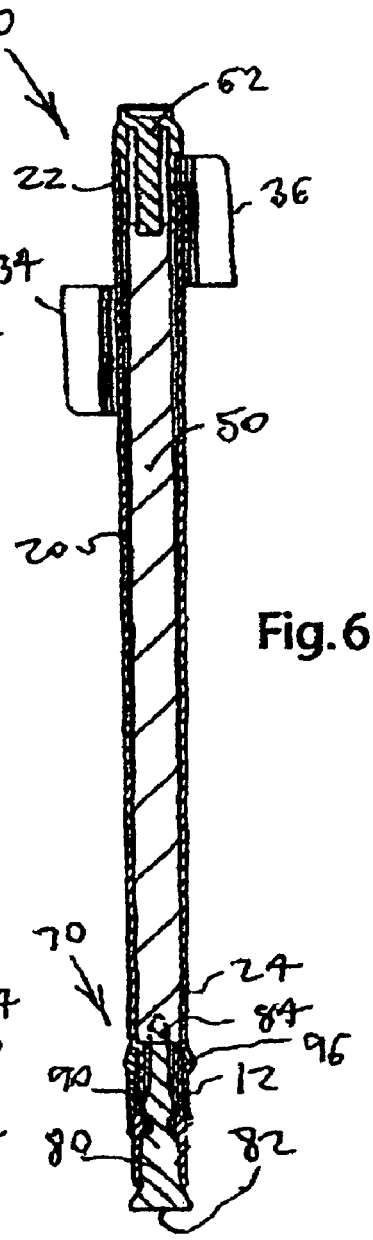
FIG. 6 is a cross-sectional side view of the marker of FIG. 4.
Figure 5A:
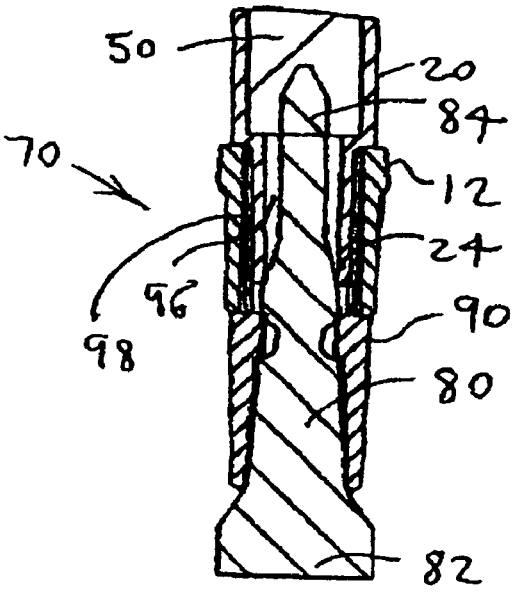
FIG. 5A is a broken away cross-sectional side view of the distal end of the modular marker of FIG. 4.
Figure 5B:
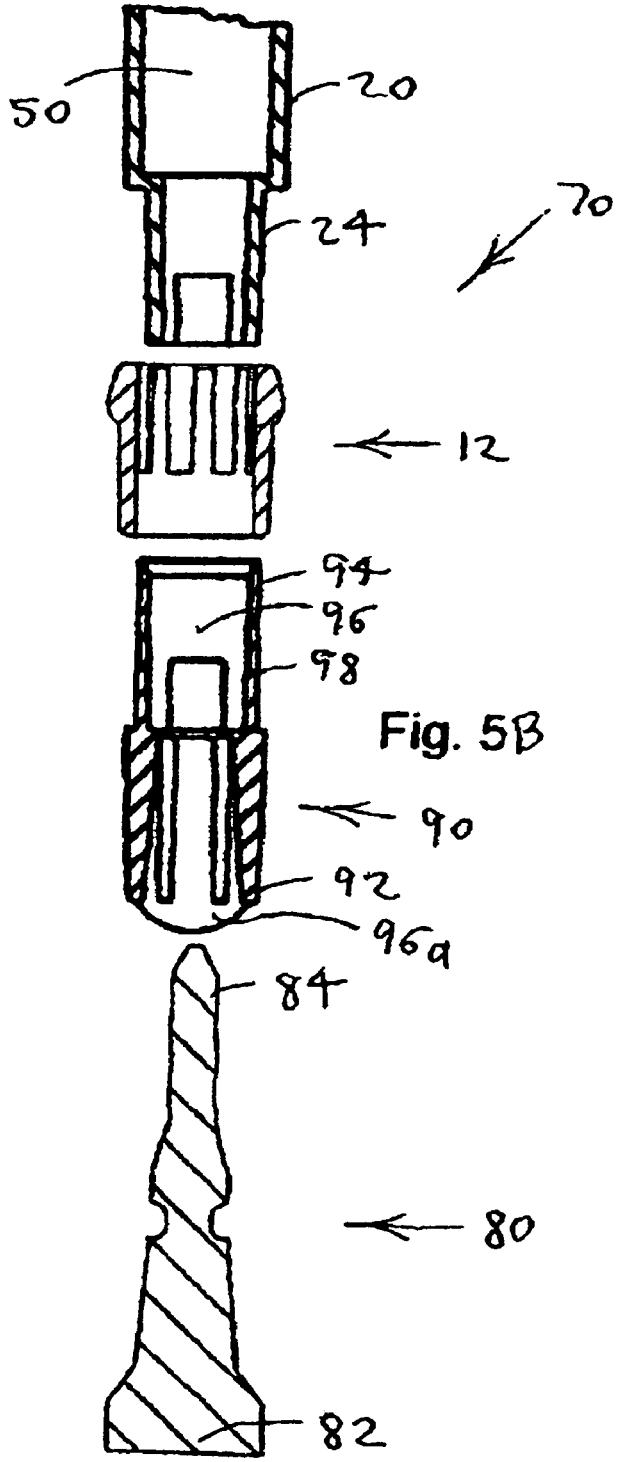
FIG. 5B is an exploded view of the elements shown in FIG. 5A.
Figures 7, 7A, 7B, 7C:
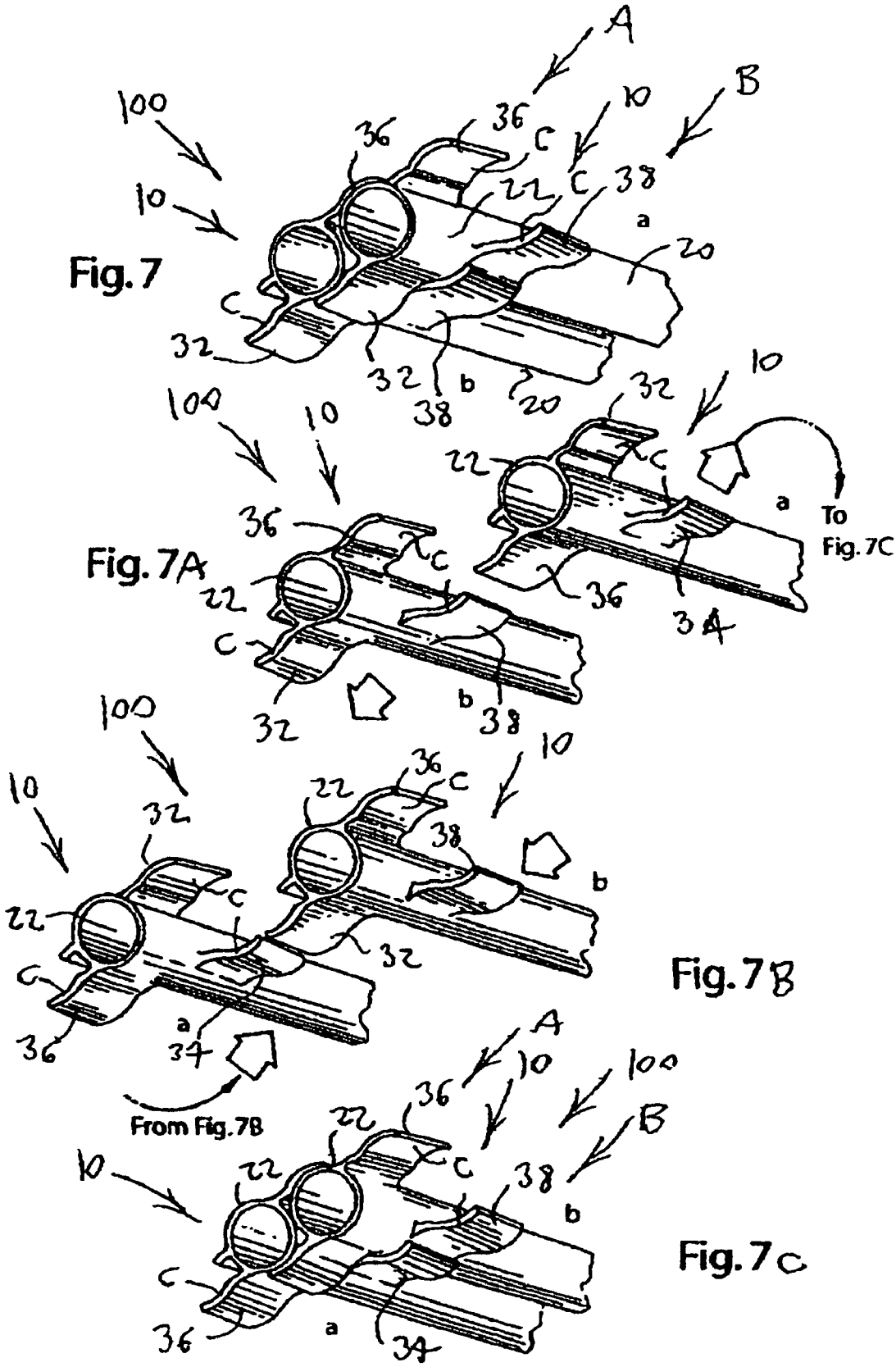
FIG. 7 is a broken away perspective view of the housing proximal ends of two present modular markers showing how the interconnection arms interconnect the two markers, interconnection being accomplished by the arm second set of the marker on the left and the arm first set of the marker on the right.
FIG. 7A is a view as in FIG. 7 showing the marker on the right rotated to present the arm second set for interconnection with the marker on the left.
FIG. 7B is a view as in FIG. 7 showing the marker on the left rotated to present the arm first set for interconnection with the marker on the right.
FIG. 7C is a view as in FIG. 7B showing the modular markers interconnected.
Figure 8:
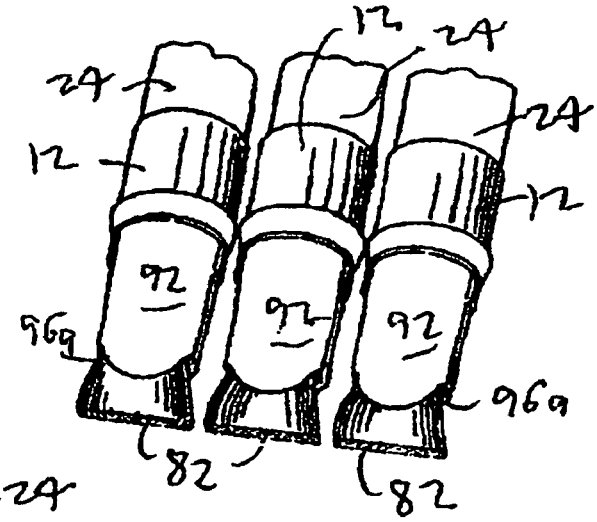
FIG. 8 is a broken away side view of the distal ends of three present adjacent modular markers where the elastomeric rings are not compressed against each other.
Figure 9:
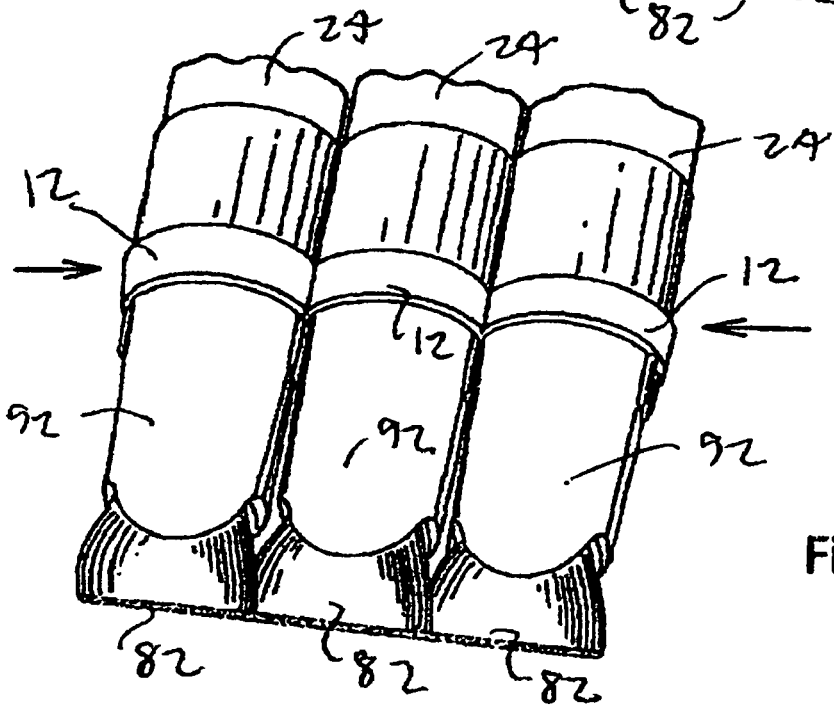
FIG. 9 is a view as in FIG. 8 with the markers laterally pressed together so that the abutting elastomeric rings are compress to bring the nibs into lateral contact with each other.
Figure 10:
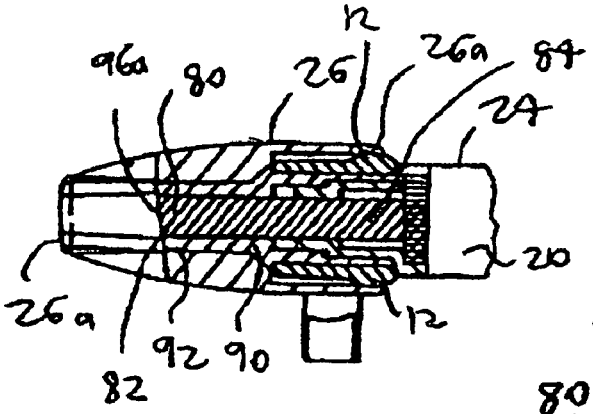
FIG. 10 is a cross-sectional side view of the distal end of a marker, showing detail of the nib, nib holder and cap.
Figure 10A:
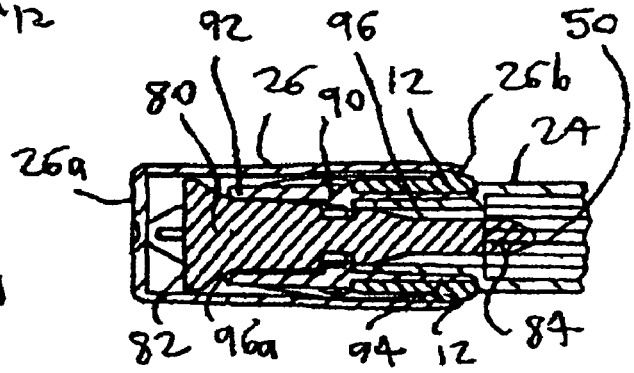
FIG. 10A is a view as in FIG. 10 with the marker rotated 90 degrees about its longitudinal axis.
Figure 11:
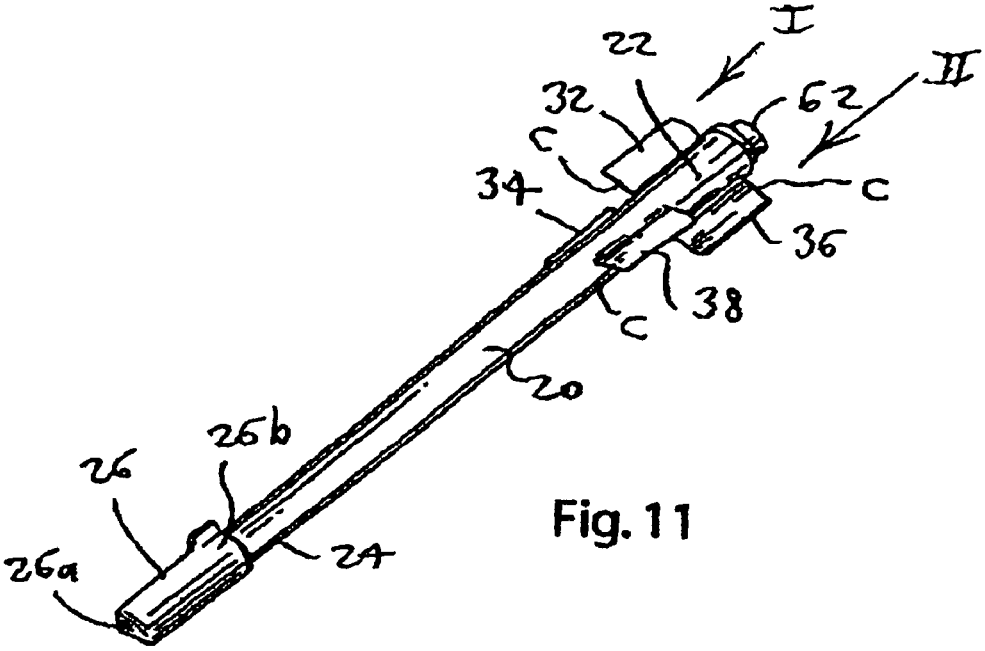
FIG. 11 is a perspective view of the present marker with the cover cap secured over the housing distal end.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-19, a modular marker 10 and modular marker kit 100 including several modular markers 10 are disclosed. Each modular marker 10 is removably interconnectable to another such modular marker 10 along a straight line in selectable numbers and combinations.

Each modular marker 10 includes a marker housing 20 in the form of a circular tube having a housing proximal end 22 and having a housing distal end 24 into which pigment material P is delivered. A tubular cover cap 26 is provided having a cap closed end 26*a* and a cap open end 26*b* for fitting over the housing distal end 24. The housing 20 of each marker 10 has laterally protruding marker interconnection arms 32, 34, 36 and 38 for engaging an adjacent such marker 10 so that markers 10 are interconnectable and can be only be interconnected along a collective straight line. Each interconnection arm 32-38 (hereinafter "arm") is flexible and resilient and has a curve C along its length to fit around the curvature of and resiliently engage an adjacent marker housing 10. First and second arm sets I and II, each including two arms 32 and 34, or 36 and 38, protrude from the marker housing 20 in directly opposing directions, so that two spaced apart arm engaging pairs A and B interconnect adjacent markers 10 in mutually parallel relation, preventing the markers 10 from pivoting relative to each other out of parallel. For purposes of this application, the term "arm set" I or II refers to two arms 32 and 34 or 36 and 38 protruding from one side of the marker housing 20, while the term "arm pair" A or B refers to the arms working in unison to interconnect two markers 10.

A key feature of each arm set I and II is that the two arms 32 and 34 or 36 and 38 making up the set are staggered in that they are spaced apart from each other along the length of the housing 20 from which they protrude, so that each arm set I and II includes an arm set upper arm 32 or 36 and an arm set lower arm 34 or 38. The upper and lower arms 32 and 34 or 36 and 38 of a given arm set I and II combine with the lower and upper arms 34 and 32 or 38 and 36 of an adjacent arm set I or II of another marker 10 to produce an upper arm pair A and a lower arm pair B, spaced longitudinally from the upper arm pair A. Each arm set I and II contributes one given upper arm 32 or 36 to the upper arm pair A and one lower arm to the lower arm pair B interconnecting two markers 10. The upper and lower arms of each arm set I and II, in addition to being staggered longitudinally, extend from the marker housing 20 at circumferentially spread apart angular positions. The upper arms 32 and 36 of the two arm sets I and II preferably are diametrically opposite each other, and the lower arms 34 and 38 of the two arm sets I and II preferably are diametrically opposite each other, so that the upper and lower positions of the arms of one arm set I or II on one marker 10 are reversed from upper and lower positions of the arms of the arm set I or II of an adjacent marker 10. The staggered arm construction permits either arm set I or II on one marker 10 to interconnect with either arm set I or II on another such marker 10, whether the marker distal ends 24 are pointing in the same direction or in opposite directions. As a result, there is no need to study which way a given marker housing 20 has to be oriented to connect to another such marker housing 20.

The pigment material P of each marker 10 preferably is ink retained within a cylindrical ink reservoir 50, which in turn is retained within the marker housing 20. The housing proximal end 22 is open so that the ink reservoir 50 can be inserted and removed from the housing 20 for replacement, and a housing plug 62 is removably and engagingly fitted into the housing proximal end 22 to sealingly close the housing proximal end 22 and thus retain the ink reservoir 50 without any leakage. Pigment delivery means 70 are provided for delivering the pigment material P from the housing 20 onto a receiving surface RS. These pigment delivery means 70 preferably include a marking nib 80 in fluid communication with the ink reservoir 50. The nib 80 is of uniform thickness and tapers proximally, having a broad, flat nib distal end 82 which is laterally wider than the nib holder 90 but not as wide as the elastomeric ring 12 and has a tapered nib proximal end 84. The nib 80 is mounted within a tubular nib holder 90 containing an axial holder passageway 96 opening distally as a nib exposing slot 96*a* in the holder distal end 92 permitting the nib 80 to protrude both distally and laterally from the nib holder 90. The nib proximal end 84 protrudes proximally beyond the nib holder proximal end 94 to enter the ink reservoir 50 within the housing 20. The passageway 96 within the nib holder 90 is wider at the holder proximal end 94 and sized to fit snugly over the housing distal end 24. An elastomeric ring 12 resiliently fits around and into a reduced diameter segment 98 of the nib holder 90. This widens the nib holder 90 so that it protrudes radially beyond the lateral extent of the nib 80, and the cover cap open end 26*b* is able to slide over the nib and is sized to slide snugly, sealingly and engagingly over the elastomeric ring 12 so that air cannot leak into the housing 20 and dry out the ink and ink cannot leak out of the marker 10 when the marker 10 is not in use. The elastomeric ring 12 is also resiliently deformable to an extent that when marker 10 cover caps 26 are removed and one marker 10 is interconnected with another marker 10 and the marker elastomeric rings 12 are consequently immediately adjacent and abutting each other, the rings compress sufficiently that the nibs 80 of the markers 10 laterally abut each other to produce composite parallel marks M of different colors which are contiguous. As a result, the elastomeric ring 12 provides its sealing function without interfering with the interconnection function of the interconnection arms 32-38 placing the nib distal ends 82 adjacent to each other.

The nib material itself inventively differs from those of previous marking pens. Most multi-color marking pen manufacturers have used high density or lower porosity nibs with precise tips, such as longitudinally aligned fiber and porous plastic, versus the "fuzziness" of die cut needled non-woven material nibs, to ensure that the nibs do not become muddied by touching the adjacent nibs. If two or more nibs are continuously touching for one hour or longer, their inks can mingle to an extent that the entire nibs and even the ink reservoirs can be muddied. Therefore, they are careful to use nibs without fraying fibers that would result in ink mingling. The result is shown in FIG. 12 in the form of such a nib, of synthetic needle-punched material, with finely entangled, compacted fibers, and without transverse fibers protruding. When two of the nibs shown in FIG. 12 are used in multicolor modular markers, such as those of a prior invention of applicant disclosed in U.S. Pat. No. 6,554,517, they typically produce uneven lines with gaps as shown in FIG. 13. The synthetic material may be polyester only or a polyester blend.

Figure 14:
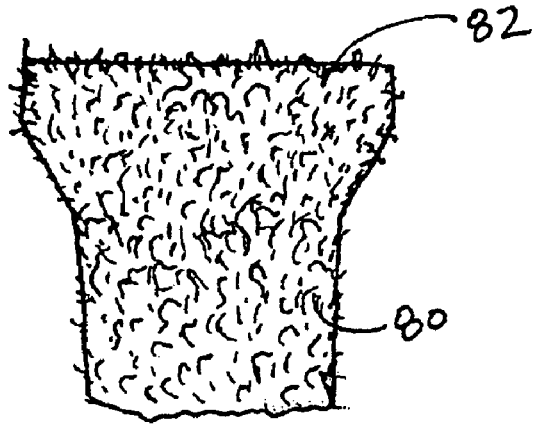
FIG. 14 is a view of a nib as in FIG. 12 before being brushed.

To ensure that there are no gaps or uneven lines, the present nib as shown in FIG. 14 that is of the same material as that of FIG. 13 but of lower density, that is less compacted, more porous, softer, more flexible, and with fibers slightly frayed and protruding for "fuzziness". As a result, the present nib combines the advantages of previous harder die cut nibs with those of a flat, natural hair paint brush. A nib body formed of this material has the advantage of being able to hold ink/paint in its pores without dripping when not in use, and can easily distribute ink/paint transversely to adjacent nibs because of its protruding multi-directional fibers. It is even more advantageous if, at the same time, the nib tip has had its fibers loosened and aligned mostly parallel to the nib axis by rubbing, brushing or sanding the nib, so that the nib material resembles a hair or bristle brush, giving it a soft, brush-like flexibility. See FIG. 14A. Methods used to achieve a brush-like tip may be rotary wire-brushing with a wheel-shaped brush, or sanding with medium grit sandpaper such as 100 garnet.

Figure 14A:
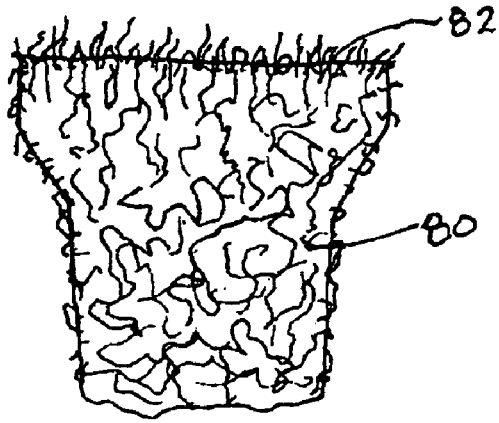
FIG. 14A is a view as in FIG. 14 of a nib after being brushed with its tip fibers loosened and aligned.
Figure 15:
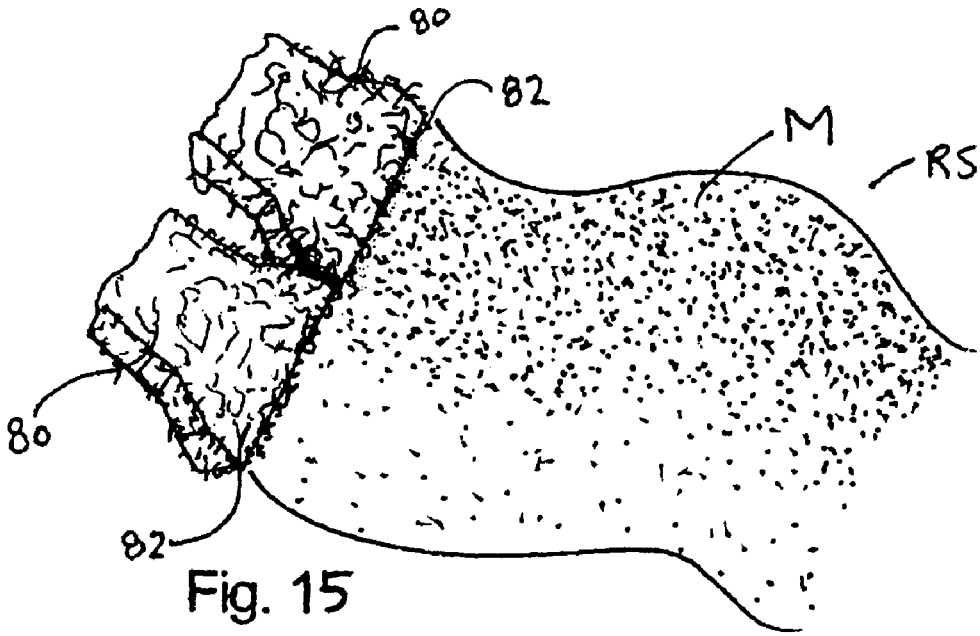
FIG. 15 is a perspective view of two of the nibs of FIG. 14A aligned adjacently and then pressed against and drawn over a receiving surface such as paper.

The benefits of such a nib as shown in FIGS. 14 and 14A are illustrated in FIG. 16, which shows two of the nibs put together as would occur for interconnected multicolor modular markers. The nibs are then pressed against a receiving surface such as paper and the fibers protruding transversely from each nib cross over to the adjacent nib, enabling the inks of each modular marker to intermingle or blend. The fibers also help to bridge any gaps between the nibs. Another benefit is that the softness and flexibility of the nib material permits the nib to be pressed further down onto the paper with less pressure, thus helping to overcome any misalignment that could prevent the nibs from creating a contiguous line. Misalignment is to be expected during normal use due to a number of factors: a nib may become bent, pushed too far into the nib holder, or slightly pulled out of the nib holder, nibs being manufactured to different lengths or used at different rates causing slightly different lengths, or slight flexing or rotation of the marker body during manufacture, for example.

FIG. 16 shows the same wick material as shown in FIG. 14, but made into a basic painting brush 110. It is a simple rectangular shape with enough length for the user fingers to grip to manipulate the brush 110 without having to squeeze too hard and without dropping the brush 110. It need not be "fuzzy" as in FIG. 14A, since different colors are applied onto adjacent parts of the same brush tip, where slight blending occurs until the brush 110 is used and the ink flows longitudinally toward the paper or other receiving surface RS medium. This nib-brush 110 works better than any sponge product, being already engineered to prime porosity, density and flow rate for wicking and laying down water-based inks/paints. The brush 110 may be cut into varying shapes and sizes, even with slits, or uneven edges for texturing effects.

Further advancements are shown in FIG. 17 which shows a brush handle 120 fixed onto a brush 110 of the same synthetic needle-punched wick material as shown in FIG. 16. The handle 120 may be natural or synthetic material. Examples are wood, bamboo, sheet metal, metal tubing, molded plastic and acrylic sheet. The handle 120 may be fixed onto the brush 120 by means of glue, hot glue, stapling, sewing, pressure fitting and taping, or by other means.

FIG. 18 shows elements of an ink P dispensing means including an ink/paint vessel such as a plastic squeeze bottle, a wick 220 extending from the bottom of the vessel 210 through an opening 216 in the vessel 210 top and protrudes outwardly a few millimeters to dispense the paint or ink P thereof, a means for reducing the size of the vessel opening 216 to fit the shape of the wick 220, the colored fluid such as ink P and a container cap 212, thus preventing ink P spillage and excess ink P evaporation. Other contemplated vessels 210 include an eye dropper or a nasal spray bottle, or a jar or vial, made of glass or a type of plastic. The no-spill means as shown in FIG. 18 is preferably provided in the form of a plug 214 which seals the vessel opening 216 around the wick 220 to prevent ink or paint from flowing around the wick 220 and leaking when the vessel 210 is accidentally tipped onto its side, or shaken while uncapped. Other means may be provided in the shape or of the body of the vessel 210, or a plug, or a seal, or in the configuration of the cap 212 or in the configuration of a wick 220. Cap 212 is provided to cover and seal the vessel 210 when not in use.

The vessel 210 with wick 220 shown in FIG. 18 is useful in multi-color painting because, to apply ink P onto a specific part of the brush 218 one simply has to touch that part of the brush 218 tip onto the wick 220 until sufficient ink P is absorbed.

FIG. 19 shows a possible configuration for a painting kit 300. The kit 300 shown includes four brushes 310, four containers 320 of different colored of paint or ink P and a tray 340 to conveniently organize everything. Additionally, other items with the kit 300 may be provided such as paper towel samples for blotting, a container for holding water, a number of sheets of paper and an instruction book. The kit 300 shown does limit the configuration possibilities.

The kit 300 may contain as few as one brush 310 and two colors of ink/paint P, or as many as desired. It may contain the ink vessel 210 shown in FIG. 18 or other type not shown.

The brush 310 shown with the kit 300 may comprise the simple brush 310 shown in FIG. 16, or it may contain the type of brush 310 shown in FIG. 17, or a combination thereof.

The water container may be a separate container or molded into the tray 340 if made of molded plastic. The containers 320 of ink/paint P may be situated in the tray 340 in preformed molded indentations or holes, or removably adhered with VELCRO™ stickers. The tray 340 may be of molded plastic, vacuum formed plastic, cardboard, laminated cardstock weight paper or other common materials that are used in packaging. The tray 340 holds the brushes 310, supporting the handle portion.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. Interconnectable modular markers for delivering pigment onto a receiving surface, comprising:

a first marker comprising a tubular housing having a housing proximal end and a housing distal end; a quantity of pigment material contained within said housing; and a first arm set comprising two interconnection arms connected to and protruding laterally from said housing in substantially the same direction for engaging an adjacent such marker, said arms being staggered and spaced apart along the length of said housing, one said arm being an upper arm and one said arm being a lower arm;

a second marker comprising a tubular housing having a housing proximal end and a housing distal end; a quantity of pigment material contained within said housing; and a first arm set comprising two interconnection arms connected to and protruding laterally from said housing in substantially the same direction for engaging an adjacent such marker, said arms being staggered and spaced apart along the length of said housing, one said arm being an upper arm and one said arm being a lower arm;

such that one of the spaced apart upper and lower arms of said first arm set protruding from said first marker fit engagingly around the tubular housing of said second marker, and the spaced apart upper and lower arms of said first arm set protruding from said second marker fit engagingly around the tubular housing of said first marker to thereby interconnect each pair of adjacent markers, preventing interconnected markers from pivoting relative to each other, and such that each marker contributes one arm to a mutually interconnecting upper arm pair and one arm to a mutually interconnecting lower arm pair.

2. The modular marker of claim 1, wherein each said interconnection arm is flexible and resilient.

3. A modular marker for delivering pigment onto a receiving surface, comprising:

a tubular housing having a housing proximal end and a housing distal end;

a quantity of pigment material contained within said housing;

and first and second arm sets of interconnection arms connected to and protruding laterally from said housing for engaging an adjacent such marker, said arms forming each said arm set being staggered and spaced apart along the length of said housing, each said arm set including an upper arm and a lower arm;

wherein each said interconnection arm has a curve along its length to fit around and resiliently engage an adjacent said marker housing;

such that spaced apart upper and lower arm pairs are adapted to interconnect each pair of adjacent markers, preventing interconnected markers from pivoting relative to each other, and such that each lateral arm set contributes one arm to said upper arm pair and one arm to said lower arm pair.

4. The modular marker of claim 1, wherein said upper and lower interconnection arms of each said lateral arm set, in addition to being staggered longitudinally, extend from said marker housing at circumferentially spaced apart angles.

5. The modular marker of claim 1, wherein said quantity of pigment material is ink retained within a cylindrical ink reservoir, and wherein said housing proximal end is open such that said ink reservoir can be inserted and removed from said housing for replacement through said housing proximal end, and wherein a housing plug is removably and engagingly fitted into the housing proximal end to sealingly close said housing proximal end.

6. The modular marker of claim 1, additionally comprising pigment delivery means for delivering said pigment material from said housing onto a receiving surface.

7. The modular marker of claim 6, wherein said pigment delivery means comprises a marking nib in fluid communication with an ink reservoir.

8. A modular marker for delivering pigment onto a receiving surface, comprising:

a tubular housing having a housing proximal end and a housing distal end;

a quantity of pigment material contained within said housing;

and first and second arm sets of interconnection arms connected to and protruding laterally from said housing for engaging an adjacent such marker, said arms forming each said arm set being staggered and spaced apart along the length of said housing, each said arm set including an upper arm and a lower arm;

such that spaced apart upper and lower arm pairs are adapted to interconnect each pair of adjacent markers, preventing interconnected markers from pivoting relative to each other, and such that each lateral arm set contributes one arm to said upper arm pair and one arm to said lower arm pair;

pigment delivery means for delivering said pigment material from said housing onto a receiving surface;

wherein said pigment delivery means comprises a marking nib in fluid communication with an ink reservoir;

and a tubular nib holder having a holder proximal end connected to said housing distal end and having a holder distal end and containing an axial holder passageway opening through the holder distal end as a nib exposing slot in said holder distal end permitting said nib to protrude both distally and laterally from said nib holder, and wherein said nib has a broad flat nib distal end and a tapered nib proximal end and said nib is mounted within said tubular nib holder and said nib proximal end protrudes proximally beyond said nib holder proximal end to receiving ink from said ink reservoir within said housing.

9. The modular marker of claim 8, additionally comprising a cover cap having a cover cap open end, and an elastomeric ring resiliently fit around said nib holder, such that said elastomeric ring protrudes radially beyond the lateral extent of said nib holder, and wherein said cover cap open end is sized to fit snugly, sealingly and engagingly over said elastomeric ring preventing ink from leaking out of said marker housing.

10. The modular marker of claim 9, wherein said elastomeric ring is resiliently deformable to an extent that when said marker cover cap is removed from said marker housing and one said marker is interconnected with another said marker, and said marker elastomeric rings are consequently immediately adjacent and abutting each other, said elastomeric rings compress sufficiently that said nib distal ends of said markers substantially laterally abut each other to produce composite parallel marks on a receiving surface of different colors which are contiguous.

11. The modular marker of claim 1, wherein said first marker additionally comprises a second arm set of two interconnection arms extending in a direction substantially opposite the direction in which said first arm set extends for engaging the tubular housing of a third said marker;

and wherein said second marker additionally comprises a second arm set of two interconnection arms extending in a direction substantially opposite the direction in which said first arm set extends for engaging the tubular housing of a fourth said marker.

12. Interconnectable modular markers for delivering pigment onto a receiving surface, comprising:

a first marker comprising a tubular housing having a housing proximal end and a housing distal end; a quantity of pigment material contained within said housing; and a first arm set comprising two interconnection arms connected to and protruding laterally from said housing in substantially the same direction for engaging an adjacent such marker;

a second marker comprising a tubular housing having a housing proximal end and a housing distal end; a quantity of pigment material contained within said housing; and a first arm set comprising two interconnection arms connected to and protruding laterally from said housing in substantially the same direction for engaging an adjacent such marker;

such that the interconnection arms of said first arm set of said first marker fit engagingly around the tubular housing of said second marker and the interconnection arms of said first arm set of said second marker fit engagingly around the tubular housing of said first marker to interconnect said first and second markers.

13. Interconnectable modular markers for delivering pigment onto a receiving surface, comprising:

a first marker comprising a tubular housing having a housing proximal end and a housing distal end; a quantity of pigment material contained within said housing; and a first arm set comprising two interconnection arms connected to and protruding laterally from said housing in substantially the same direction for engaging an adjacent such marker;

a second marker comprising a tubular housing having a housing proximal end and a housing distal end; a quantity of pigment material contained within said housing;

such that the interconnection arms of said first arm set of said first marker fit engagingly around the tubular housing of said second marker to interconnect said first and second markers.

* * * * *